US008491838B2

(12) United States Patent
Hamano et al.

(10) Patent No.: US 8,491,838 B2
(45) Date of Patent: Jul. 23, 2013

(54) LOW THERMAL EXPANSION NI-BASE SUPERALLOY

(75) Inventors: Shuji Hamano, Tokyo (JP); Shigeki Ueta, Nagoya (JP); Ryuichi Yamamoto, Takasago (JP); Yoshikuni Kadoya, Nagasaki (JP); Takashi Nakano, Tokyo (JP); Shin Nishimoto, Tokyo (JP)

(73) Assignees: Daido Tokushuko Kabushiki Kaisha (JP); Mitsubishi Heavy Industries, Ltd. (JP)

( * ) Notice: Subject to any disclaimer, the term of this patent is extended or adjusted under 35 U.S.C. 154(b) by 1052 days.

(21) Appl. No.: 11/808,614

(22) Filed: Jun. 12, 2007

(65) Prior Publication Data

US 2007/0284018 A1 Dec. 13, 2007

(30) Foreign Application Priority Data

Jun. 13, 2006 (JP) ..... P.2006-163969

(51) Int. Cl.
*C22C 19/05* (2006.01)

(52) U.S. Cl.
USPC ..... 420/448; 148/428

(58) Field of Classification Search
USPC ..... 148/428; 420/451, 448–450
See application file for complete search history.

(56) References Cited

U.S. PATENT DOCUMENTS

| | | | | | |
|---|---|---|---|---|---|
| 3,655,458 | A * | 4/1972 | Reichman | ..... | 419/15 |
| 4,400,211 | A * | 8/1983 | Kudo et al. | ..... | 420/443 |
| 4,789,410 | A * | 12/1988 | Parizek | ..... | 148/527 |
| 4,810,466 | A | 3/1989 | Choi et al. | ..... | 420/447 |
| 6,458,318 | B1 * | 10/2002 | Nishiyama et al. | ..... | 420/448 |
| 7,160,400 | B2 * | 1/2007 | Magoshi et al. | ..... | 148/410 |
| 2003/0005981 | A1 * | 1/2003 | Ogawa et al. | ..... | 148/428 |

FOREIGN PATENT DOCUMENTS

| | | | |
|---|---|---|---|
| DE | 3 428 316 | * | 2/1986 |
| EP | 1 035 225 | A1 | 9/2000 |
| EP | 1 591 548 | A1 | 11/2005 |
| JP | 9-157779 | | 6/1997 |
| JP | 2005-314728 | * | 11/2005 |

OTHER PUBLICATIONS

English Abstract and English Machine Translation of Ueda, et al. (JP 2005-314728) (Nov. 2005).*
Notification of Reasons for Refusal from Patent Application 2006-163969 drafted Apr. 22, 2011.

* cited by examiner

*Primary Examiner* — Jessee R. Roe
(74) *Attorney, Agent, or Firm* — Bacon & Thomas, PLLC

(57) ABSTRACT

The present invention relates to a low thermal expansion Ni-base superalloy containing, in terms of mass %, C: 0.15% or less; Si: 1% or less; Mn: 1% or less; Cr: 5% or more but less than 20%; at least one of Mo, W and Re, in which Mo+½(W+Re) is 5% or more but less than 20%; W: 10% or less; Al: 0.1 to 2.5%; Ti: 0.10 to 0.95%; Nb+½Ta: 1.5% or less; B: 0.001 to 0.02%; Zr: 0.001 to 0.2%; Fe: 4.0% or less; and a balance of inevitable impurities and Ni, in which the total amount of Al, Ti, Nb and Ta is 2.0 to 6.5% in terms of atomic %. The low thermal expansion Ni-base superalloy of the present invention has a thermal expansion coefficient almost equal to that of 12 Cr ferritic steel, excellent high temperature strength, excellent corrosion and oxidation resistance, good hot-workability, and excellent weldability.

4 Claims, 2 Drawing Sheets

LOW THERMAL EXPANSION NI-BASE SUPERALLOY

FIELD OF THE INVENTION

The present invention relates to a low thermal expansion Ni-base superalloy with excellent weldability, which is suitable for the application to large-sized parts such as a rotor and a disc of a steam turbine or gas turbine, particularly those used at a high temperature of 600 to 800° C.

BACKGROUND OF THE INVENTION

Conventionally, as a material for the rotor to be used at high temperature portion of a steam turbine or gas turbine, 12 Cr ferritic steel having a low thermal expansion coefficient (e.g., C: 0.14%, Si: 0.05%, Mn: 0.50%, Ni: 0.6%, Cr: 10.3%, Mo: 1.5%, V: 0.17%, Nb: 0.06% and Fe: the balance) has been mainly used.

However, in recent years, in order to improve thermal efficiency, for example in a steam turbine, development has progressed so as to elevate the steam temperature to 650° C. or higher.

When the steam temperature is elevated to such high temperature, heat-resistant strength required for large-sized parts such as rotor also increases, so that conventional 12 Cr ferritic steel cannot be applied such requirement.

Thus, in view of material quality, materials having high heat-resistant strength at the higher temperature have been required.

For the material therefor, there has been known austenitic superalloys (e.g., A-286 (Cr: 15%, Ni: 26%, Mo: 1.25%, Ti: 2%, Al: 0.2%, C: 0.04%, B: 0.005%, V: 0.3%, Fe: the balance), Inconel 617 (Cr: 22%, Co: 12.5%, Mo: 9%, Al: 1%, C: 0.07%, Ni: the balance), Inconel 625 (Cr: 21.5%, Mo: 9%, Nb: 3.6%, Ti: 0.2%, Fe: 2.5%, C: 0.05%, Ni: the balance), or Inconel 706 (Cr: 16%, Ti: 1.75%, Al: 0.2%, Fe: 37.5%, C: 0.03%, Nb+Ta: 2.9%, Ni: the balance), which are excellent in corrosion resistance and oxidation resistance and have a excellent high temperature strength in comparison with 12 Cr ferritic steel.

However, they have an excellent high temperature strength but have a high thermal expansion coefficient, so that there is a problem that design flexibility is low.

All the parts constituting the steam turbine etc. are not necessarily exposed to 650° C. or higher and some parts are not required to have such high temperature strength, so that it is possible to use conventional 12 Cr ferritic steel for such parts.

In this case, it can be considered for the turbine structure to be assembled with 12 Cr ferritic steel and austenitic superalloys, but there is a possibility of inconvenience caused by a difference in thermal expansion.

In view of the application, austenitic superalloys with low thermal expansion coefficient have been disclosed in Patent Document 1.

Whereas a rotor of the steam turbine is extremely large and hence it is difficult to form whole structure with an austenitic superalloy. Therefore, a welded rotor in which plurality of rotor (disc) materials are produced and are subsequently integrated by welding is employed.

Consequently, materials for the combined welded rotor are required to have an excellent weldability.

In this regard, Patent Document 1 does not note any such weldability.

Moreover, although the above-mentioned individual rotor (disc) is smaller than a mono-block rotor, the welded rotor (disc) is also large and hence an excellent hot-workability is required for materials constituting the rotor (disc).

Patent Document 1: JP-A-9-157779

SUMMARY OF THE INVENTION

Under the above-mentioned circumstances, it is an object of the invention to provide a γ' precipitation hardening Ni-base superalloy with low thermal expansion which is almost equal to that of 12 Cr ferritic steel, excellent high temperature strength, excellent corrosion and oxidation resistance, good hot-workability, and excellent weldability.

DETAILED DESCRIPTION OF THE INVENTION

Figure 1:
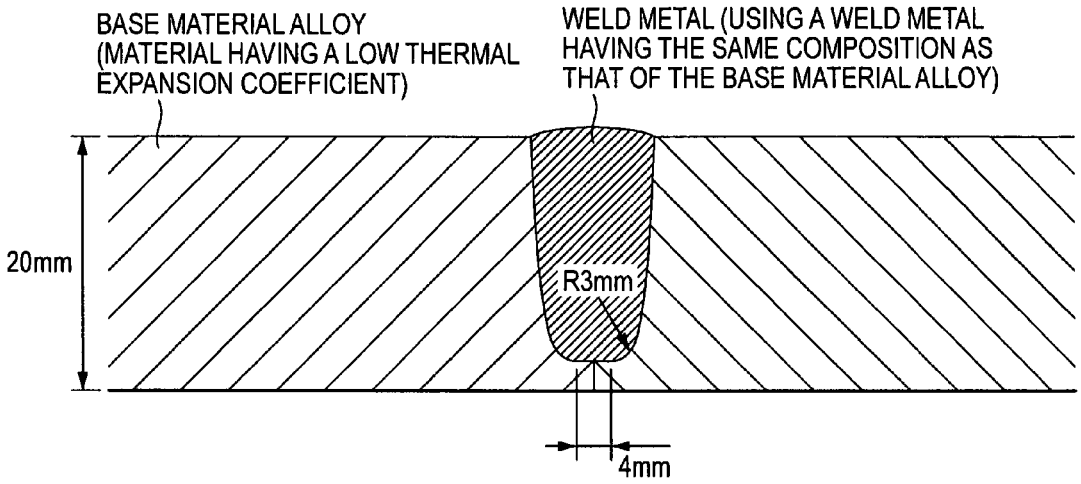
FIG. 1 is a figure illustrating a TIG welded joint.

Namely, the present invention relates to the followings.

(1) A low thermal expansion Ni-base superalloy comprising, in terms of mass %,

C: 0.15% or less;

Si: 1% or less;

Mn: 1% or less;

Cr: 5% or more but less than 20%;

at least one of Mo, W and Re, in which Mo+½(W+Re) is 5% or more but less than 20%;

W: 10% or less;

Al: 0.1 to 2.5%;

Ti: 0.10 to 0.95%;

Nb+½Ta: 1.5% or less;

B: 0.001 to 0.02%;

Zr: 0.001 to 0.2%;

Fe: 4.0% or less; and a balance of inevitable impurities and Ni, wherein the total amount of Al, Ti, Nb and Ta is 2.0 to 6.5% in terms of atomic %.

(2) The low thermal expansion Ni-base superalloy according to (1) above, further comprising, in terms of mass %, Co: 0.5% or more but less than 5.0%.

(3) The low thermal expansion Ni-base superalloy according to (1) or (2) above, wherein Mo+½(W+Re) is 5% or more but less than 10%.

In this specification, "%" means "mass %" unless otherwise indicated. Furthermore, all percentages and the like defined by mass are the same with those by weight.

In the present invention, the amounts of Al+Ti+Nb+Ta and Mo+½(W+Re) are properly set, in particular, the amount of Ti to be added is set at such a low amount of 0.10 to 0.95%.

In the β' precipitation hardening austenitic Ni-base superalloy by addition of Ti, β' precipitation phase ($Ni_3(Al, Ti)$), in which Al in $Ni_3Al$ is partially substituted with Ti, is formed.

The addition of Ti strengthens the β' phase and also lowers the thermal expansion coefficient. The high temperature strength of the Ni-base superalloy is enhanced due to the γ' phase. The effect thereof can be maintained in the case where Ti is added in an amount of 0.10% or more.

Moreover, in the component system of the invention, the high temperature strength can be gotten as well as that of the conventional Ni-base superalloys by addition of Ti up to 1% (specifically 0.95%), and the high temperature strength further increases by increasing Ti.

However, when Ti is added in an amount exceeding 0.95%, welding is inhibited owing to low weldability.

On the other hand, when the addition of Ti exceeds 0.95%, the solidus temperature of the γ' phase increases and the precipitation of the γ' phase on cooling at hot forging is fast, so that hot-workability is deteriorated.

Furthermore, since Ti is apt to be segregated and is also apt to cause the precipitation of the η phase which is an embrittling phase, cracking is apt to occur starting from the η phase, which also causes the deterioration of hot-workability.

Therefore, at the production of the above-mentioned large-sized rotor (disc), forging crack and heat crack may be generated at high possibility.

Moreover, when welding is performed, weld crack is apt to be generated starting from the segregated portion of Ti.

The invention is accomplished based on such findings and an excellent weldability can be secured with maintaining good high temperature strength, low thermal expansion and hot-workability, by setting the amount of Ti to be added at 0.95% or less.

The low thermal expansion Ni-base superalloy of the invention can be produced in the same manner as in the case of the conventional Ni-base superalloys. In the heat treatment, after a heat treatment for solid solution at 950° C. or higher, both of single aging (600 to 850° C.) and two-step aging (first step: 700 to 900° C., second step: 600 to 750° C.) are effective.

Moreover, the low thermal expansion Ni-base superalloy of the invention may have a mean thermal expansion coefficient of $14.5\times10^{-6}$/° C. or less, desirably $14.0\times10^{-6}$/° C. or less, within a temperature range of from room temperature to 700° C.

The following will describe in detail the reasons why each chemical component is limited in the invention.

C: 0.15% or Less

C is an element contained in order to form carbides in combination with Ti, Nb, Cr and Mo, thereby to enhance the high-temperature strength and to prevent grain coarsening. Since hot-workability is deteriorated when the content thereof exceeds 0.15%, the content is limited to 0.15% or less, desirably 0.10% or less.

Si: 1% or Less

Si is added not only as a deoxidant but also to improve the oxidation resistance. Since ductility is lowered when Si is contained in an amount exceeding 1%, the content thereof is limited to 1% or less, desirably 0.5% or less.

Mn: 1% or Less

Similar to Si, Mn is added as a deoxidant. When Mn is contained in an amount exceeding 1%, not only the high temperature oxidation characteristic is deteriorated but also the precipitation of the η phase ($Ni_3Ti$) spoiling the ductility is promoted. Therefore, the content thereof is limited to 1% or less, desirably 0.5% or less.

Cr: 0.5% or More but Less than 20%

Cr is an element which dissolves in the austenite phase and is contained in order to improve the high temperature oxidation resistance and corrosion resistance.

In order to maintain a sufficient high temperature oxidation resistance and corrosion resistance, a larger content of Cr is desired. However, Cr increases the thermal expansion coefficient, so that the content thereof is desirably less than 20% in view of the thermal expansion.

In order to obtain a target thermal expansion coefficient in the vicinity of 650 to 700° C., which is a target temperature to be used in the invention, the Cr content is desirably 5% or more but less than 20%.

In order to maintain a sufficient high temperature oxidation resistance and corrosion resistance, the content thereof is desirably 10% or more.

Mo+½(W+Re): 5 or More but Less than 20%

Mo, W and Re are elements which dissolve in the austenite phase and are contained in order to increase the high temperature strength due to solid solution hardening and to lower the thermal expansion coefficient.

In order to obtain the target thermal expansion coefficient intended in the invention, it is necessary that the contents of one or more of these elements are selected so that Mo+½(W+Re) becomes 5% or more. When Mo+½(W+Re) is 20% or more, not only hot-workability is deteriorated but also an embrittling phase is precipitated to reduce the ductility. Therefore, Mo+½(W+Re) is limited to 5% or more but less than 20%.

Moreover, when Mo+½(W+Re) is less than 17%, precipitation of $A_2B$ phase can be suppressed and phase stability can be enhanced. More desirably, the content thereof is less than 10%.

Furthermore, when W is added in an amount exceeding 10%, α-W precipitates and hot-workability is lowered, so that W is desirably limited to 10% or less.

Since Mo lowers oxidation resistance, the content thereof is preferably less than 17% and, in order to obtain a better effect, it is desirably less than 10%.

Ti: 0.10 to 0.95%

Ti forms the γ' phase in combination with Ni to strengthen the β' phase, lowers the thermal expansion coefficient, and promotes the aging precipitation hardening of the γ' phase.

In order to obtain such effects, Ti is contained in an amount of 0.10% or more in the invention.

On the other hand, when Ti is added excessively in an amount exceeding 0.95%, the precipitation of the η phase ($Ni_3Ti$) which is an embrittling phase is promoted, weldability and also hot-workability are deteriorated, and also ductility is deteriorated. Therefore, an upper limit thereof is set at 0.95%.

Al: 0.1 to 2.5%

Al is the most important element to enhance oxidation resistance and to form the γ' phase in combination with Ni to thereby strengthen the alloy by precipitation, and hence is contained in the alloy.

When the content thereof is less than 0.1%, the precipitation of the γ' phase is insufficient. When Ti, Nb and Ta are present in large amounts, the γ' phase becomes unstable and the η phase and δ phase precipitate to cause embrittlement, which deteriorates hot-workability and makes it difficult to forge and mold the alloy into parts. Therefore, the content thereof is set at 0.1 to 2.5%, and preferably 0.2% or more but less than 2.0%.

B: 0.001% to 0.02%, Zr: 0.001 to 0.2%

B and Zr segregate at grain boundary to increase creep strength. In addition, B has an effect of suppressing the precipitation of η phase in the alloy containing a large amount of Ti. However, excessive contents of these elements deteriorate hot-workability and weldability, so that the content of B is set at 0.001% to 0.02% and the content of Zr is set at 0.001 to 0.2%.

Co: 0.5% or More but Less than 5.0%

Co increases the high temperature strength through solid solution in the alloy. The addition of 0.5% or more thereof is necessary to obtain such effect and, since Co is expensive, the content thereof is set at less than 5%.

Nb+½Ta: 1.5% or Less

Nb and Ta are elements to form the γ' phase ($Ni_3$(Al, Nb, Ta)) which is a precipitation strengthening phase of Ni-base superalloys. These elements have effects of not only strengthening the γ' phase but also preventing the coarsening of the γ' phase, so that they are contained in the alloy. However, when they are contained excessively, the δ phase ($Ni_3$(Nb, Ta)) is precipitated to lower hot-workability and ductility. Therefore, the contents thereof are set so that Nb+½Ta satisfies 1.5% or less. A desired range thereof is 1.0% or less.

Fe: 4.0% or Less

Fe is added in order to reduce the cost of the alloy or contained in the alloy through the use of crude ferroalloys as mother materials to be added to the alloy for adjusting components such as W and Mo.

Fe decreases the high temperature strength of the alloy and increases the thermal expansion coefficient. Therefore, it is preferable that the content thereof is low. When the content thereof is 4.0% or less, the influences on the high temperature strength and the thermal expansion coefficient are small, so that an upper limit thereof is set at 4.0%. More desirably, the content thereof is limited to 2.0% or less.

Ni: the Balance

Ni is a main element which creates austenite which serves as a matrix, and which can enhance heat resistance and corrosion resistance.

In addition, Ni forms the γ' phase which is a precipitation strengthening phase.

Al+Ti+Nb+Ta: 2.0 to 6.5% in Terms of Atomic %

Al, Ti, Nb and Ta are elements constituting the γ' phase. Therefore, when there is sufficient amount of Ni, the volume fraction of the precipitated γ' phase is proportional to the total of the atomic percents of these elements.

Moreover, since the high temperature strength is proportional to the volume fraction of the γ' phase, the high temperature strength increases proportionally to the total of the atomic percents of these elements.

In order to obtain a sufficient strength intended in the invention, the total amount thereof is required to be 2.0 atomic % or more. However, when the total amount thereof exceeds 6.5 atomic %, the volume fraction of the γ' phase is excessively increased thereby to deteriorate hot-workability remarkably, so that the total amount thereof is set at 2.0 to 6.5% in terms of atomic %, desirably 3.5 to 6.0% in terms of atomic %.

Other Elements (Inevitable Impurities)

With regard to elements Mg, Ca, P, S and Cu, the properties of the low thermal expansion Ni-base superalloy according to the invention is not deteriorated so long as Mg: 0.03% or less, Ca: 0.03% or less, P: 0.05% or less, S: 0.01% or less, and Cu: 2% or less.

The present invention is now illustrated in greater detail with reference to Examples and Comparative Examples.

The alloys having the compositions shown in Tables 1 and 2 were respectively melted under vacuum and then cast to prepare respective ingots weighing 50 kg.

TABLE 1

| | | Chemical composition (% by mass) | | | | | | | | | | | | | | | | | | (Atomic %) |
|---|---|---|---|---|---|---|---|---|---|---|---|---|---|---|---|---|---|---|---|---|
| | Alloy | C | Si | Mn | Fe | Co | Cr | Re | Mo | W | Ta | Nb | Al | Ti | Zr | B | Ni | *1 | *2 | *3 |
| Alloy of the invention | 1 | 0.03 | 0.05 | 0.05 | 0.50 | — | 12.0 | — | 6.2 | 7.0 | — | — | 1.50 | 0.90 | 0.04 | 0.004 | Bal. | 9.7 | 0 | 4.5 |
| | 2 | 0.03 | 0.05 | 0.05 | 0.50 | — | 12.0 | — | 12.2 | 7.0 | — | — | 1.50 | 0.89 | 0.03 | 0.004 | Bal. | 15.7 | 0 | 4.6 |
| | 3 | 0.04 | 0.21 | 0.36 | 0.65 | — | 18.2 | — | 15.9 | — | — | 0.6 | 1.61 | 0.61 | 0.01 | 0.012 | Bal. | 15.9 | 0.6 | 4.7 |
| | 4 | 0.05 | 0.15 | 0.11 | 0.44 | — | 8.5 | 1.8 | 14.4 | 1.8 | — | — | 0.98 | 0.75 | 0.01 | 0.008 | Bal. | 16.2 | 0 | 3.2 |
| | 5 | 0.02 | 0.12 | 0.24 | 0.16 | 3.21 | 15.6 | — | 13.5 | 4.2 | — | 0.3 | 1.39 | 0.85 | 0.01 | 0.003 | Bal. | 15.6 | 0.3 | 4.4 |
| | 6 | 0.02 | 0.05 | 0.05 | 0.49 | — | 12.1 | — | 6.2 | 7.0 | — | — | 1.85 | 0.80 | 0.04 | 0.003 | Bal. | 9.7 | 0 | 5.1 |
| | 7 | 0.03 | 0.08 | 0.12 | 0.55 | — | 9.9 | — | 8.2 | 7.0 | 0.5 | 0.3 | 2.11 | 0.55 | 0.03 | 0.004 | Bal. | 11.7 | 0.6 | 5.8 |
| | 8 | 0.03 | 0.10 | 0.21 | 0.38 | — | 14.0 | — | 10.2 | 9.0 | — | — | 1.60 | 0.95 | 0.01 | 0.005 | Bal. | 14.7 | 0 | 4.9 |
| | 9 | 0.03 | 0.19 | 0.19 | 0.62 | — | 11.3 | — | 5.6 | 8.2 | — | — | 1.77 | 0.91 | 0.01 | 0.005 | Bal. | 9.7 | 0 | 5.1 |
| | 10 | 0.04 | 0.33 | 0.13 | 0.36 | — | 12.4 | — | 7.8 | 3.7 | — | — | 2.06 | 0.79 | 0.02 | 0.003 | Bal. | 9.7 | 0 | 5.5 |
| | 11 | 0.07 | 0.14 | 0.30 | 0.93 | 1.26 | 13.8 | — | 9.3 | — | — | — | 1.73 | 0.83 | 0.02 | 0.007 | Bal. | 9.3 | 0 | 4.7 |
| | 12 | 0.06 | 0.26 | 0.22 | 0.67 | — | 10.9 | — | 6.6 | 7.8 | 0.7 | — | 1.38 | 0.94 | 0.01 | 0.006 | Bal. | 10.5 | 0.35 | 4.6 |
| | 13 | 0.05 | 0.09 | 0.11 | 0.72 | — | 14.7 | — | 7.9 | 2.4 | — | 0.8 | 2.22 | 0.68 | 0.03 | 0.005 | Bal. | 9.1 | 0.8 | 6.1 |
| | 14 | 0.04 | 0.17 | 0.28 | 0.40 | — | 11.5 | 0.9 | 8.7 | 1.9 | — | — | 1.79 | 0.76 | 0.01 | 0.004 | Bal. | 10.1 | 0 | 4.9 |

TABLE 2

| | | Chemical composition (% by mass) | | | | | | | | | | | | | | | | | | (Atomic %) |
|---|---|---|---|---|---|---|---|---|---|---|---|---|---|---|---|---|---|---|---|---|
| | Alloy | C | Si | Mn | Fe | Co | Cr | Re | Mo | W | Ta | Nb | Al | Ti | Zr | B | Ni | *1 | *2 | *3 |
| Comparative alloy | 1 | 0.05 | 0.50 | 1.35 | Bal. | — | 15.0 | — | 1.3 | — | V: 0.3 | — | 0.23 | 1.99 | — | 0.005 | 26.0 | 1.3 | 0 | 2.9 |
| | 2 | 0.07 | 0.17 | 0.22 | 0.1 | 12.5 | 22.0 | — | 9.0 | — | — | — | 1.02 | — | — | — | Bal. | 9 | 0 | 2.0 |
| | 3 | 0.05 | 0.20 | 0.18 | 2.5 | — | 21.5 | — | 9.0 | — | — | 3.6 | 0.22 | 0.20 | — | — | Bal. | 9 | 3.6 | 3.0 |
| | 4 | 0.03 | 0.20 | 0.20 | Bal. | — | 16.0 | — | — | — | — | 2.9 | 0.21 | 1.78 | — | — | 41.5 | 0 | 2.9 | 4.4 |
| | 5 | 0.03 | 0.09 | 0.09 | 0.52 | — | 14.1 | — | 13.1 | 6.0 | — | — | 1.99 | 1.59 | — | 0.003 | Bal. | 16.1 | 0 | 6.5 |
| | 6 | 0.03 | 0.05 | 0.06 | 0.51 | — | 12.1 | — | 10.2 | 15.0 | — | — | 1.50 | 0.90 | — | 0.003 | Bal. | 17.7 | 0 | 4.8 |

*1 = Mo + ½(W + Re)
*2 = Nb + ½Ta
*3 = Al + Ti + Nb + Ta

The test specimen having a diameter of parallel portion of 4.5 mm was cut away from each ingot and then it was subjected to a soaking heat treatment at 1200° C. for 16 hours. Thereafter, the specimen was subjected to a Greeble tensile testing at a temperature of 1100° C. to 1200° C. at a tensile rate of 50.8 mm/second. Productivity (hot-workability) of a large-sized component was evaluated by an average reduction of area.

Additionally, each ingot was homogenized at 1200° C. for 16 hours and then was forged into rod having a diameter of 15 mm.

Each rod was subjected to a solution treatment (heated at 1100° C. for 2 hours and then water-cooled) and an aging treatment (heated at 750° C. for 24 hours) and then a mean thermal expansion coefficient from room temperature thereof was measured.

With regard to the measurement of the thermal expansion coefficient, the mean thermal expansion coefficient within a temperature range of from room temperature to 700° C. was measured by a differential dilatometry on an apparatus for thermomechanical analysis TMA manufactured by RIGAKU DENKI Co. Ltd., using quartz as a standard sample, under the condition of a temperature-elevating rate of 5° C./min.

In addition, tensile strength at 700° C. was measured.

Furthermore, a creep rupture test was carried out with a test specimen having a diameter of parallel portion of 6.4 mm under conditions with a temperature of 700° C. and a load of 343 MPa to evaluate a rupture life.

In addition, a continuous oxidation test under conditions at 700° C. for 200 hours and also a steam oxidation test under conditions at 700° C. for 1000 hours were carried out to measure an oxidation weight gain, to evaluate oxidation resistance. The oxidation test and the steam oxidation test were carried out in accordance with JIS Z 2281, and the test environments were normal pressure, a steam concentration of 83%, and a steam flow rate of 7.43 ml/s.

The weldability, which is an important property in the invention, was evaluated as follows.

A TIG welded joint having a shape shown in FIG. 1 was prepared under TIG welding conditions shown in Table 3 and its weldability was evaluated.

TABLE 3

| Welding method | Welding current (A) | Welding voltage (V) | Welding speed (mm/min) | Wire diameter (ϕ mm) | Wire-feeding speed (mm/min) | Pre-heating | Shield gas Ar (L/min) | Welding position |
|---|---|---|---|---|---|---|---|---|
| TIG welding | 160 | 12 | 80 | 1.0 | 300 | None | 15 | Flat position |

At this moment, an alloy consisting of the same composition as well as the base alloy was used as a welding metal.

With regard to the presence of welding cracks, cross-sectional texture investigation was carried out after the welding and the presence of cracks was confirmed.

The comparative alloy 1 in Table 2 is the above-mentioned A-286, the comparative alloy 2 is Inconel 617, the comparative alloy 3 is Inconel 625, and the comparative alloy 4 is Inconel 706.

The comparative alloy 5 is an alloy in which the content of Ti exceeds the upper limit of the invention. Moreover, the comparative alloy 6 is an alloy in which the content of W exceeds the upper limit of the invention.

The results of the above each evaluation are shown in Tables 4 and 5.

TABLE 4

| | | Greeble tensile testing | | | | | | |
|---|---|---|---|---|---|---|---|---|
| | Alloy | Average reduction of area (%) of high-temperature tensile test | Average coefficient of thermal expansion from room temperature to 700° C. ($\times 10^{-6}$/° C.) | Tensile strength at 700° C. (MPa) | Creep rupture time at 700° C./343 MPa (Hr) | Oxidation weight gain in air at 700° C. × 200 h (mg/cm$^2$) | Steam oxidation weight gain at 700° C. × 1000 h (mg/cm$^2$) | Weld Crack |
| Alloy of the invention | 1 | 66 | 13.5 | 905 | 1561 | 0.07 | 0.54 | No |
| | 2 | 54 | 13.0 | 911 | 2070 | 0.11 | 0.62 | No |
| | 3 | 48 | 13.8 | 956 | 2059 | 0.05 | 0.44 | No |
| | 4 | 50 | 13.0 | 880 | 1368 | 0.14 | 0.65 | No |
| | 5 | 58 | 13.4 | 909 | 1991 | 0.07 | 0.47 | No |
| | 6 | 63 | 13.5 | 1107 | 1792 | 0.06 | 0.55 | No |
| | 7 | 57 | 13.2 | 1192 | 1994 | 0.11 | 0.56 | No |
| | 8 | 56 | 13.2 | 1088 | 2182 | 0.09 | 0.60 | No |
| | 9 | 68 | 13.4 | 1023 | 1706 | 0.06 | 0.48 | No |
| | 10 | 63 | 13.3 | 1135 | 1815 | 0.05 | 0.48 | No |
| | 11 | 70 | 13.5 | 932 | 1658 | 0.05 | 0.47 | No |
| | 12 | 62 | 13.2 | 920 | 1899 | 0.08 | 0.51 | No |
| | 13 | 63 | 13.3 | 1204 | 1931 | 0.06 | 0.47 | No |
| | 14 | 62 | 13.4 | 1071 | 1767 | 0.08 | 0.49 | No |

TABLE 5

| | Alloy | Average reduction of area (%) of high-temperature tensile test | Average coefficient of thermal expansion from room temperature to ($\times 10^{-6}$/° C.) | Tensile strength at 700° C. (MPa) | Creep rupture time at 700° C./343 MPa (Hr) | Oxidation weight gain in air at 700° C. × 200 h (mg/cm$^2$) | Steam oxidation weight gain at 700° C. × 1000 h (mg/cm$^2$) | Weld Crack |
|---|---|---|---|---|---|---|---|---|
| | | Greeble tensile testing | | | | | | |
| Comparative alloy | 1 | 74 | 18.2 | 580 | 72 | 0.11 | 0.61 | — |
| | 2 | 62 | 14.7 | 503 | 81 | 0.03 | 0.43 | — |
| | 3 | 60 | 15.0 | 693 | 93 | 0.03 | 0.39 | — |
| | 4 | 53 | 16.5 | 880 | 3520 | 0.08 | 0.50 | — |
| | 5 | 37 | 13.0 | 1223 | 2856 | 0.07 | 0.50 | Yes |
| | 6 | 22 | 13.8 | 1135 | 1885 | 0.08 | 0.63 | No |

In the results of the Gleeble tensile testing, the alloys of the invention showed ductility over 50% and hence it is confirmed that they are excellent in hot-workability.

On the other hand, the ductility (average reduction of area) of each of the comparative alloy 5 having a Ti content of 1% or more and the comparative alloy 6 to which W was excessively added was found to be under 50% in the test at 1100 to 1200° C., so that they were poor in hot-workability.

The ductility of the comparative alloys 1 and 2 are lower values.

Furthermore, in terms of both of the tensile strength at 700° C. and the creep rupture life, the alloys of the invention were found to be superior to the comparative alloys 1 to 3 which are conventional ones.

Moreover, in terms of the steam oxidation weight gain at 700° C., steam oxidation resistance of inventive alloys are equal to that of the comparative alloys 1 to 4, so that they have a good corrosion resistance.

On the other hand, with regard to the weldability, although cracking was observed at TIG welding in the comparative alloy 5 having a Ti content of 1% or more, cracking was not observed in the alloys of the invention having the content thereof of 0.95% or less.

Then, in order to investigate the relationship between the amount of Ti added and the weldability in further detail, the alloys having compositions shown in Table 6 were produced and a trans-varestrain test was carried out under condition shown in Table 7, to evaluate the weldability by determining a maximum crack length.

Figure 2:
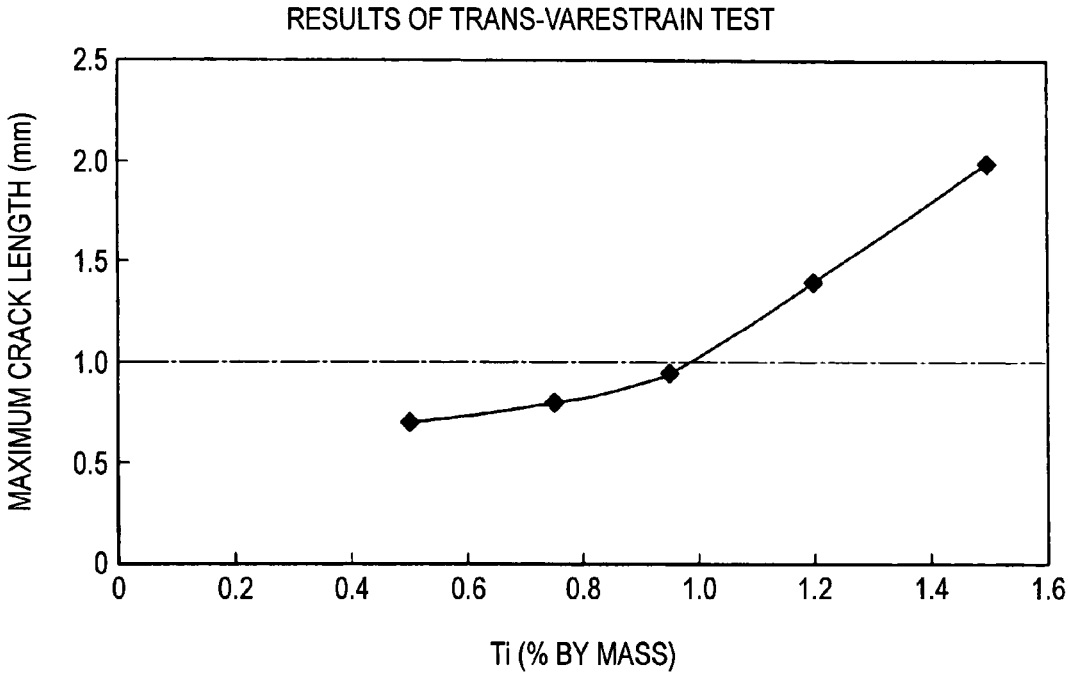
FIG. 2 is a graph showing evaluation of weldability.

The results are shown in FIG. 2.

As shown in FIG. 2, it is confirmed that the weldability is lowered as the amount of Ti increases and a maximum crack length can be achieved under 1 mm, which is a target value by setting the amount of Ti to be 0.95% or less.

While the present invention has been described in detail and with reference to specific embodiments thereof, it will be apparent to one skilled in the art that various changes and modifications can be made therein without departing from the spirit and scope thereof.

The present application is based on Japanese Patent Application No. 2006-163969 filed on Jun. 13, 2006, and the contents thereof are incorporated herein by reference.

What is claimed is:

1. A low thermal expansion Ni-base superalloy comprising, in terms of mass %, C: 0.15% or less;
Si: 1% or less;
Mn: 1% or less;
Cr: 8.5% or more but less than 20%;
at least two of Mo, W and Re, in which Mo+½(W+Re) is 9.1% or more but up to 16.2%;
W: 10% or less;
Al: 0.98% to 1.85%;
Ti: 0.10 to 0.95%;
Nb+½Ta: 1.5% or less;
B: 0.001 to 0.02%;
Zr: 0.001 to 0.2%;
Fe: 4.0% or less; and
a balance of inevitable impurities and Ni,

TABLE 6

| | Alloy | C | Si | Mn | Fe | Co | Cr | Re | Mo | W | Ta | Nb | Al | Ti | Zr | B | Ni |
|---|---|---|---|---|---|---|---|---|---|---|---|---|---|---|---|---|---|
| | | Chemical composition (% by mass) | | | | | | | | | | | | | | | |
| Alloy of the invention | 15 | 0.03 | 0.06 | 0.05 | 0.45 | — | 12.0 | — | 5.9 | 7.2 | — | — | 1.51 | 0.51 | 0.004 | 0.004 | Bal. |
| | 16 | 0.04 | 0.05 | 0.04 | 0.51 | — | 12.1 | — | 6.0 | 6.9 | — | — | 1.50 | 0.74 | 0.003 | 0.003 | Bal. |
| | 17 | 0.03 | 0.04 | 0.06 | 0.48 | — | 11.9 | — | 6.2 | 7.0 | — | — | 1.51 | 0.95 | 0.004 | 0.003 | Bal. |
| Comparative alloy | A | 0.03 | 0.06 | 0.06 | 0.49 | — | 12.0 | — | 6.1 | 6.9 | — | — | 1.49 | 1.21 | 0.004 | 0.003 | Bal. |
| | B | 0.04 | 0.04 | 0.05 | 0.43 | — | 11.9 | — | 6.0 | 7.0 | — | — | 1.50 | 1.49 | 0.005 | 0.004 | Bal. |

TABLE 7

| | | |
|---|---|---|
| Shape of test specimen | | 110 × 50 × 5t |
| Welding conditions | Welding method | TIG |
| | Welding current | 100 A |
| | Welding voltage | 9 V |
| | Welding speed | 65 mm/min |
| | Energy input | 8.3 kJ/cm |
| Strain | | 5% |

wherein the total amount of Al, Ti, Nb and Ta is 2.0 to 6.5% in terms of atomic %.

2. The low thermal expansion Ni-base superalloy according to claim 1, further comprising, in terms of mass %, Co: 0.5% or more but less than 5.0%.

3. The low thermal expansion Ni-base superalloy according to claim 1, wherein Mo+½(W+Re) is 9.1% or more but less than 10%.

4. The low thermal expansion Ni-base superalloy according to claim 2, wherein Mo+½(W+Re) is 9.1% or more but less than 10%.

* * * * *